US009820575B2

(12) United States Patent
Ham

(10) Patent No.: US 9,820,575 B2
(45) Date of Patent: Nov. 21, 2017

(54) ROTATION ADJUSTMENT SYSTEM FOR SEATS

(71) Applicant: UNITECH SYSTEM CO., LTD., Daegu (KR)

(72) Inventor: Shin Sang Ham, Daegu (KR)

(73) Assignee: UNITECH SYSTEM CO., LTD., Deagu (KR)

( * ) Notice: Subject to any disclaimer, the term of this patent is extended or adjusted under 35 U.S.C. 154(b) by 70 days.

(21) Appl. No.: 15/011,431

(22) Filed: Jan. 29, 2016

(65) Prior Publication Data

US 2016/0374469 A1 Dec. 29, 2016

(30) Foreign Application Priority Data

Jun. 26, 2015 (KR) ..... 10-2015-0091251

(51) Int. Cl.

| | |
|---|---|
| ***A47C 15/00*** | (2006.01) |
| ***A47C 1/124*** | (2006.01) |
| ***A47C 1/12*** | (2006.01) |
| ***A47C 7/56*** | (2006.01) |
| ***A47C 7/40*** | (2006.01) |

(52) U.S. Cl.

CPC ..... *A47C 1/124* (2013.01); *A47C 1/12* (2013.01); *A47C 7/407* (2013.01); *A47C 7/56* (2013.01)

(58) Field of Classification Search

CPC ..... A47C 1/124; A47C 7/407
USPC ..... 297/248, 234, 232, 243, 235
See application file for complete search history.

(56) References Cited

U.S. PATENT DOCUMENTS 1,980,497 A * 11/1934 Musgrave ..... A47C 1/126 297/248
2,985,225 A * 5/1961 Hendrickson ..... B60N 2/22 297/248
4,971,395 A 11/1990 Coussemacq et al.
5,328,238 A * 7/1994 Yamazaki ..... A47C 1/126 297/332
5,456,518 A * 10/1995 Kemppainen ..... A47C 1/126 297/232
5,597,139 A * 1/1997 Beroth ..... B64D 11/0693 244/118.6

(Continued)

FOREIGN PATENT DOCUMENTS

EP 0 336 819 A1 10/1989
KR 10-1073341 B1 10/2011

(Continued)

OTHER PUBLICATIONS

Extended European Search Report dated Oct. 26, 2016 as received in Application No. 16157678.0.

*Primary Examiner* — Jose V Chen
(74) *Attorney, Agent, or Firm* — Maschoff Brennan

(57) ABSTRACT

A rotation adjustment system for seats includes a first viewing chair and a second viewing chair. The first viewing chair includes a first seat part and a first backrest part which is stood from the first seat part to maintain the seating function of the first seat part, and is laid down toward the first seat part to disable the seating function of the first seat part. The second viewing chair includes a second seat part and a second backrest part which is stood from the second seat part to maintain the seating function of the second seat part, and is laid down toward the second seat part to disable the seating function of the second seat part.

9 Claims, 15 Drawing Sheets

1

(56) References Cited

U.S. PATENT DOCUMENTS

| | | | | |
|---|---|---|---|---|
| 7,938,485 | B1 * | 5/2011 | Perciballi | B60N 2/24 297/216.1 |
| 8,393,677 | B2 * | 3/2013 | Wieclawski | B60N 2/2222 297/234 |
| 8,833,853 | B2 | 9/2014 | Kim et al. | |
| 8,894,138 | B2 * | 11/2014 | Monahan | A47C 4/08 297/234 |
| 9,631,384 | B2 * | 4/2017 | Jacobs | E04H 3/126 |
| 2005/0168032 | A1 * | 8/2005 | Olarte | A47C 1/121 297/331 |
| 2011/0062755 | A1 * | 3/2011 | Gil | A47C 1/12 297/232 |
| 2013/0019540 | A1 * | 1/2013 | Magnus | E04H 3/126 52/8 |

FOREIGN PATENT DOCUMENTS

| | | | |
|---|---|---|---|
| KR | 10-1241161 | B1 | 3/2013 |
| KR | 10-1510601 | B1 | 4/2015 |

* cited by examiner

1

ROTATION ADJUSTMENT SYSTEM FOR SEATS

CROSS-REFERENCE TO RELATED PATENT APPLICATION

This application claims the benefit of Korean Patent Application No. 10-2015-0091251 filed on Jun. 26, 2015, in the Korean Intellectual Property Office, the disclosure of which is incorporated herein in its entirety by reference.

BACKGROUND OF THE INVENTION

1. Field of the Invention

The present invention relates to a rotation adjustment system for seats, and more particularly, to a rotation adjustment system for seats allowing a plurality of viewing chairs to be individually or simultaneously stood or laid down.

2. Description of the Related Art

In general, seats are used to improve spatial efficiency in gymnasiums, auditoriums, various theaters, event halls and the like. A plurality of movable seat steps may be sequentially spread and folded, and when folded, a space is secured by the space of the folded seats so that a wider space becomes available, while, when spread, a space and seats where a lot of people may be seated in multiple steps may be secured.

Here, a seat disposed on a seat step among a plurality of movable seat steps comprises a plurality of viewing chairs. Each viewing chair is rotated toward the lower side of the seat step located at the upper side the chair and the chair position is switched into a storage state. However, when a seat stand is drawn to the front side from the lower side of the seat stand located at the upper side, each viewing chair should be individually rotated to be used. Also, even though a lower side seat step is not moved to the lower side of an upper side seat step, there is a limitation in that each viewing chair should be individually rotated to be switched into a non-use state from a use state even in a case in which viewing chairs should be folded.

Thus, it is necessary to develop a method capable of facilitating the switching from a use state into a non-use state or from a non-use state to a use state by simultaneously rotating a plurality of viewing chairs disposed on a seat step.

SUMMARY OF THE INVENTION

The present invention provides a rotation adjustment system for seats, the system facilitating the conversion between a usable state in which users may be seated and an unusable state in which users may not be seated in such a way that the seats are simultaneously or individually stood or allowed to be laid down.

According to an aspect of the present invention, a rotation adjustment system for seats includes: a first viewing chair including a first seat part on which a user is allowed to be seated, and a first backrest part which is rotatably connected to the first seat part, is stood from the first seat part to maintain the seating function of the first seat part, and is laid down toward the first seat part to disable the seating function of the first seat part; a second viewing chair including a second seat part which is disposed adjacent to the first seat part and on which a user is allowed to be seated, and a second backrest part which is rotatably connected to the second seat part, is stood from the second seat part to maintain the seating function of the second seat part, and is laid down toward the second seat part to disable the seating function of the second seat part; in the first viewing chair, the first backrest part is stood from the first seat part to allow the laid down second backrest part to stood from the second seat part or to allow the stood second backrest part to maintain the stood state; in the second viewing chair, the second backrest part is laid down toward the second seat part to allow the stood first backrest part to be laid down toward the first seat part or to allow the laid down second backrest part to maintain the laid down state; the first backrest part includes a first rotatable part supporting the back of the user and connected to the first seat part to be rotated from the first seat part, and a protrusion part protruding from the first rotatable part toward the second backrest part so as to be positioned on a rotation path of the second rotatable part and contacting the second backrest part in case of being simultaneously stood or laid down with the second backrest part; the second backrest part includes a second rotatable part supporting the back of the user and a contact part protruding from the second rotatable part and contacting the protrusion part in case of being simultaneously stood or laid down with the first backrest part; and when the first and second backrest parts are simultaneously stood or laid down, facing surfaces of the protrusion part and the contact part are in surface-contact with each other.

The first rotatable part may include a first connection part supporting the back of the user, and a first bent part bent from the first connection part in a front surface direction, and connected to be rotated from the first seat part; and the second rotatable part may include a second connection part supporting the back of the user, and a second bent part bent from the second connection part in the front surface direction, and connected to be rotated from the second seat part.

The protrusion part may be bent from the first bent part toward the second backrest part to contact the contact part in case in which the first and second back rest parts are simultaneously stood or laid down, and the contact part may be bent from the second bent part toward the first backrest part to contact the protrusion part in case in which the first and second back rest parts are simultaneously stood or laid down.

When the first and second backrest parts are simultaneously stood or laid down, one surface of contact part may be hidden by the protrusion part.

When the first and second backrest parts are simultaneously stood or laid down, the protrusion part and the contact part may overlap each other The protrusion part may be continuously formed along the length direction of the first bent part, and the contact part may be continuously formed along the length direction of the second bent part.

A size of the protrusion part may be greater than that of the contact part

The contact part may have a length gradually decreasing in a direction away from the second bent part.

A width of the first bent part may be greater than that of the second bent part.

A width of the first bent part may be greater than that of the second bent part by a thickness of the contact part.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
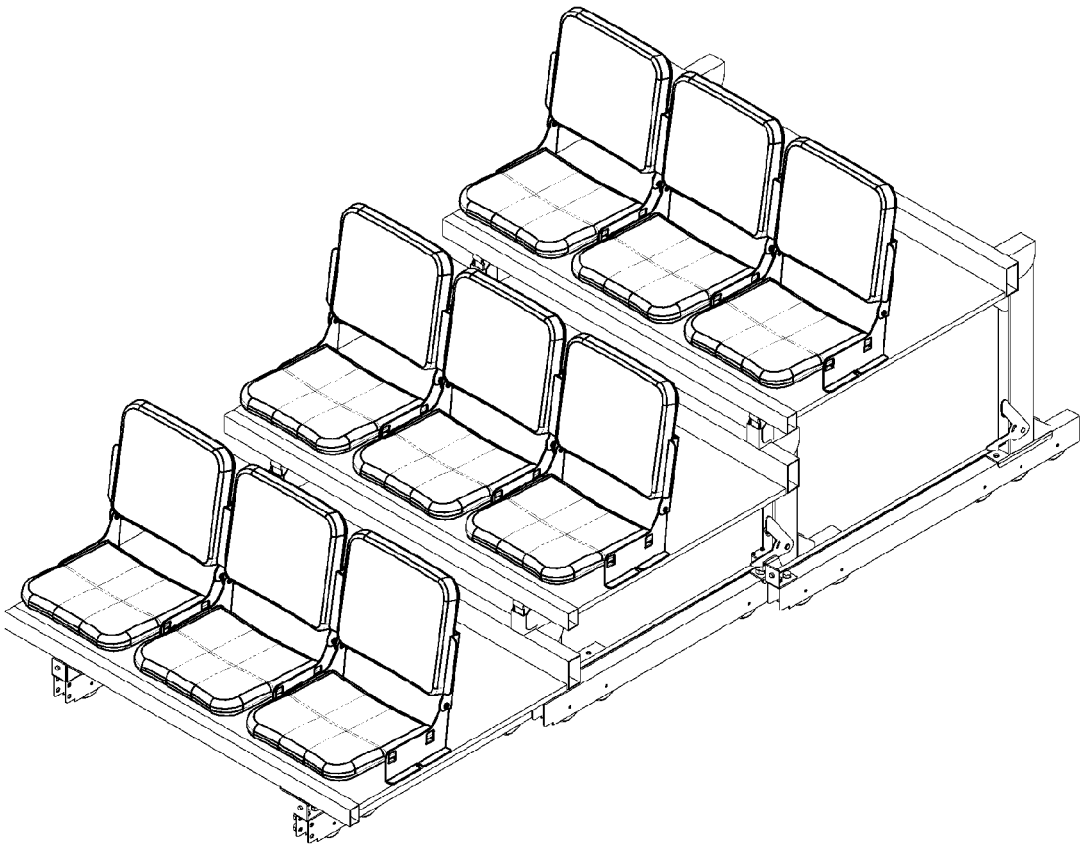
FIG. 1 is a schematic perspective view illustrating a seat, to which a rotation adjustment system for seats according to an embodiment of the present invention is applied.

Hereinafter, specific embodiments will be described in detail with reference to the drawings. The spirit and scope of the present disclosure, however, shall not be construed as being limited to embodiments provided herein. Rather, it will be apparent that other embodiments that fall within the spirit and scope of the present disclosure may easily be derived through adding, modifying, and deleting elements herein by those skilled in the art. However, such embodiments are also construed as being included in the spirit and scope of the present disclosure.

Like reference numerals denote like elements, included in the drawing of each embodiment and having the same function under the same inventive concept.

Figure 2:
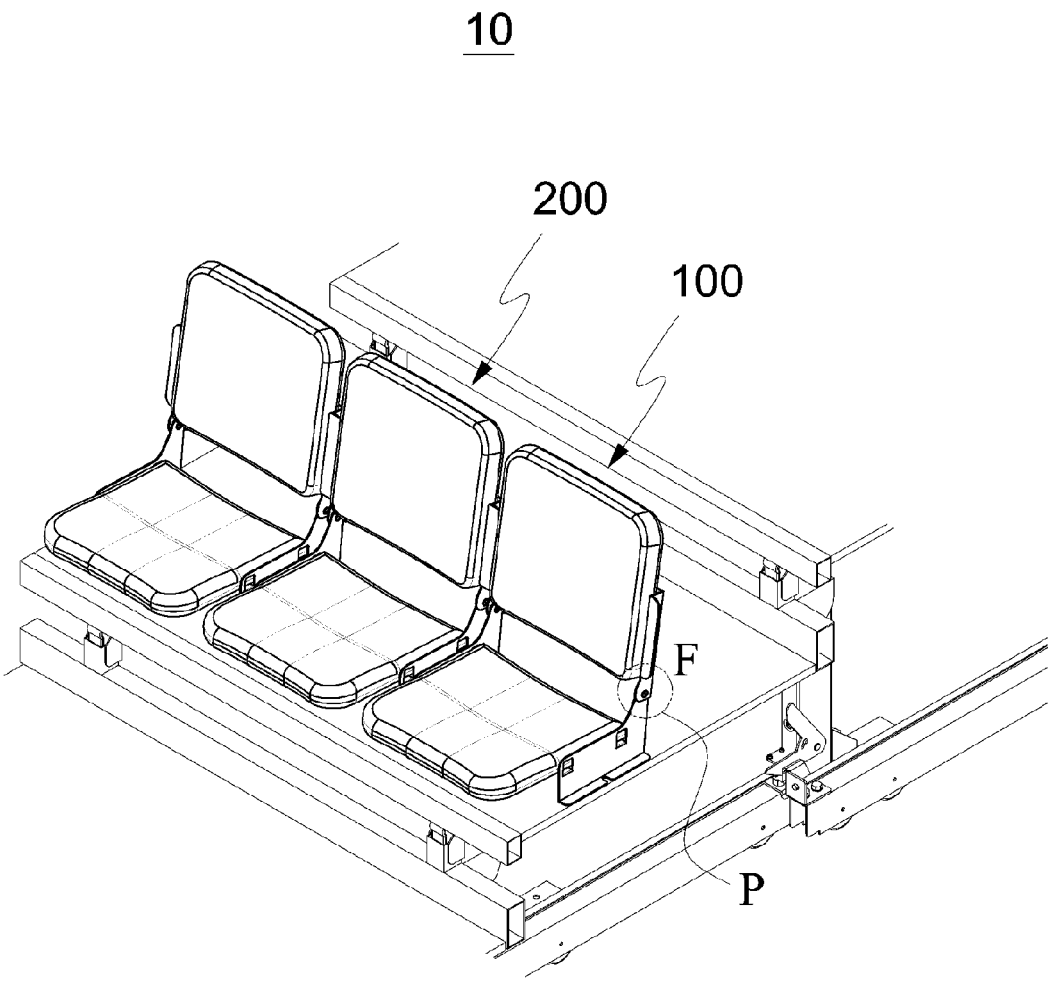
FIG. 2 is a schematic perspective view illustrating a rotation adjustment system for seats according to an embodiment of the present invention.

FIG. 1 is a schematic perspective view illustrating a seat, to which a rotation adjustment system for seats according to an embodiment of the present invention is applied, and FIG. 2 is a schematic perspective view illustrating a rotation adjustment system for seats according to an embodiment of the present invention.

Referring to FIGS. 1 and 2, a rotation adjustment system for seats according to an embodiment of the present invention may be applied to seats used to enhance the spatial efficiency in gymnasiums, auditoriums, various theaters, event halls, and the like.

That is, a plurality of movable seat steps 1 may be sequentially spread and folded, and when folded, a space is secured by the space of the folded seats so that a wider space becomes available, while when spread, a space and seats where a lot of people may be seated in multi-step may be secured.

The rotation adjustment system for seats according to an embodiment of the present invention may be applied to each viewing chair disposed on each step with a different height, and may provide a seating function by allowing a plurality of viewing chairs in any one step to be simultaneously stood, or may disable the seating function by allowing the chairs to be simultaneously laid down.

Hereinafter, a rotation adjustment system for seats according to an embodiment of the present invention applied to a viewing chair on any one step from among the plurality of seat steps 1 will be described.

That is, although a first viewing chair 100 and a second viewing chair 200 which are disposed on a specific step P will be described, the present invention is not limited thereto, but may be applied to all of the plurality of seat steps.

Figure 3:
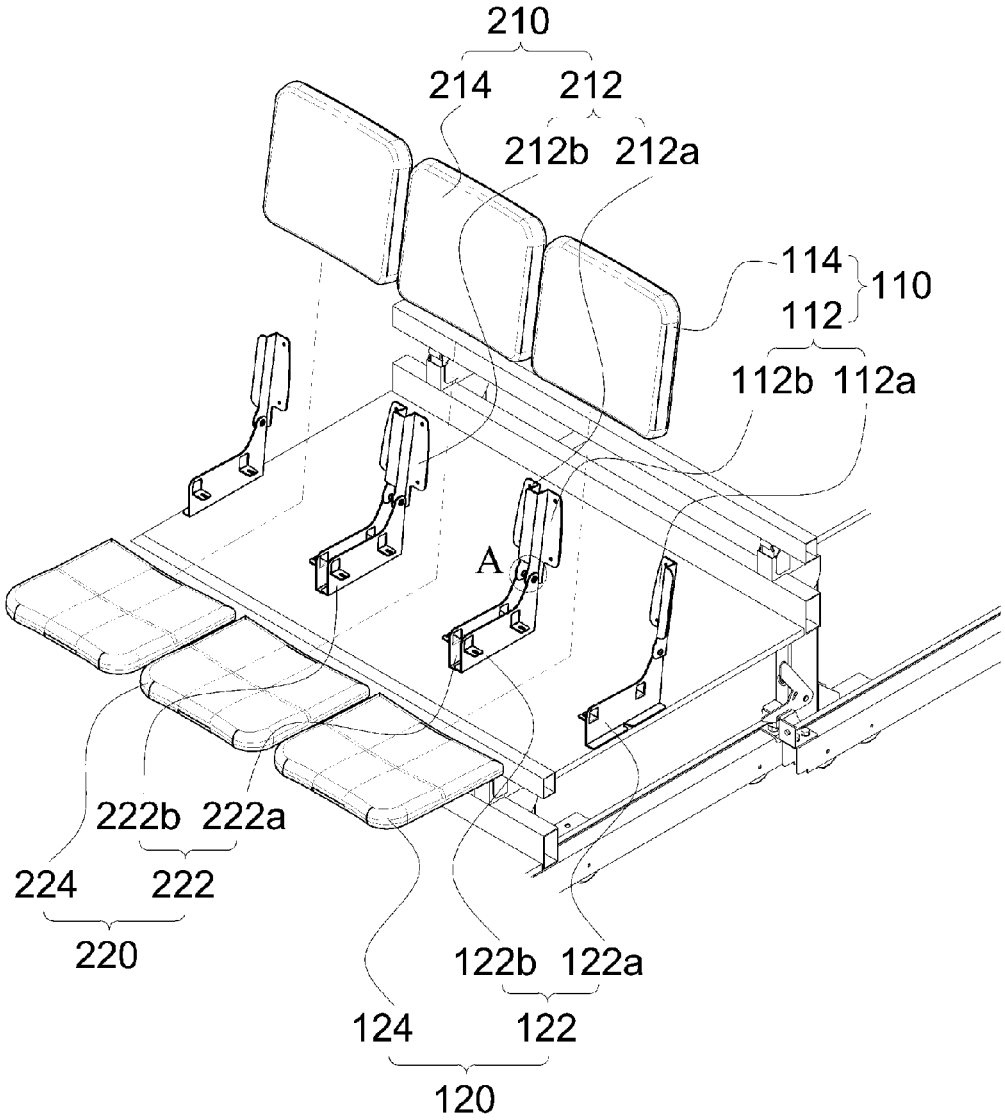
FIG. 3 is an exploded perspective view of FIG. 2.
Figure 4:
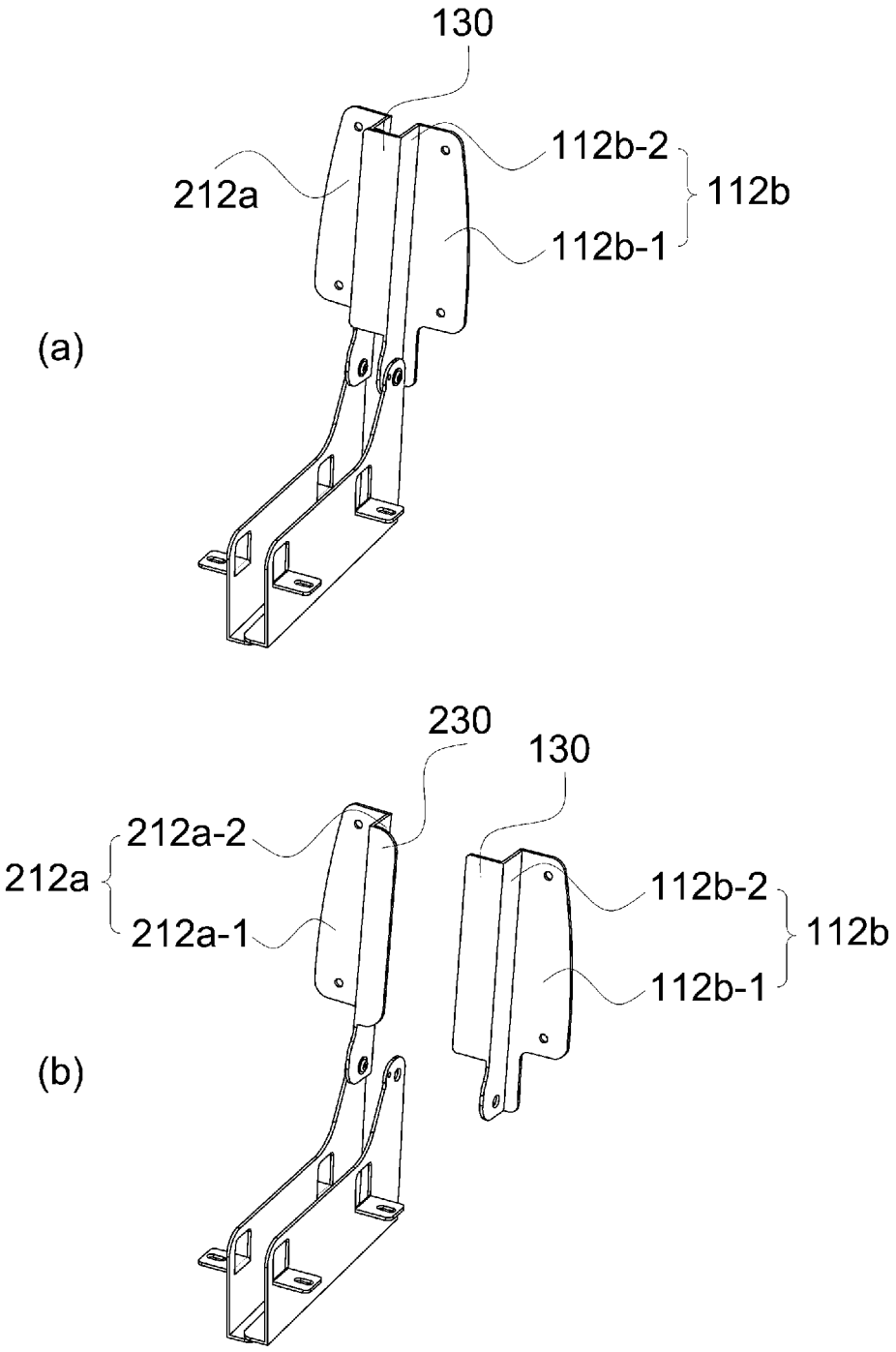
FIG. 4 is a schematic perspective view illustrating a portion of a rotation adjustment system for seats according to an embodiment of the present invention.
Figure 5:
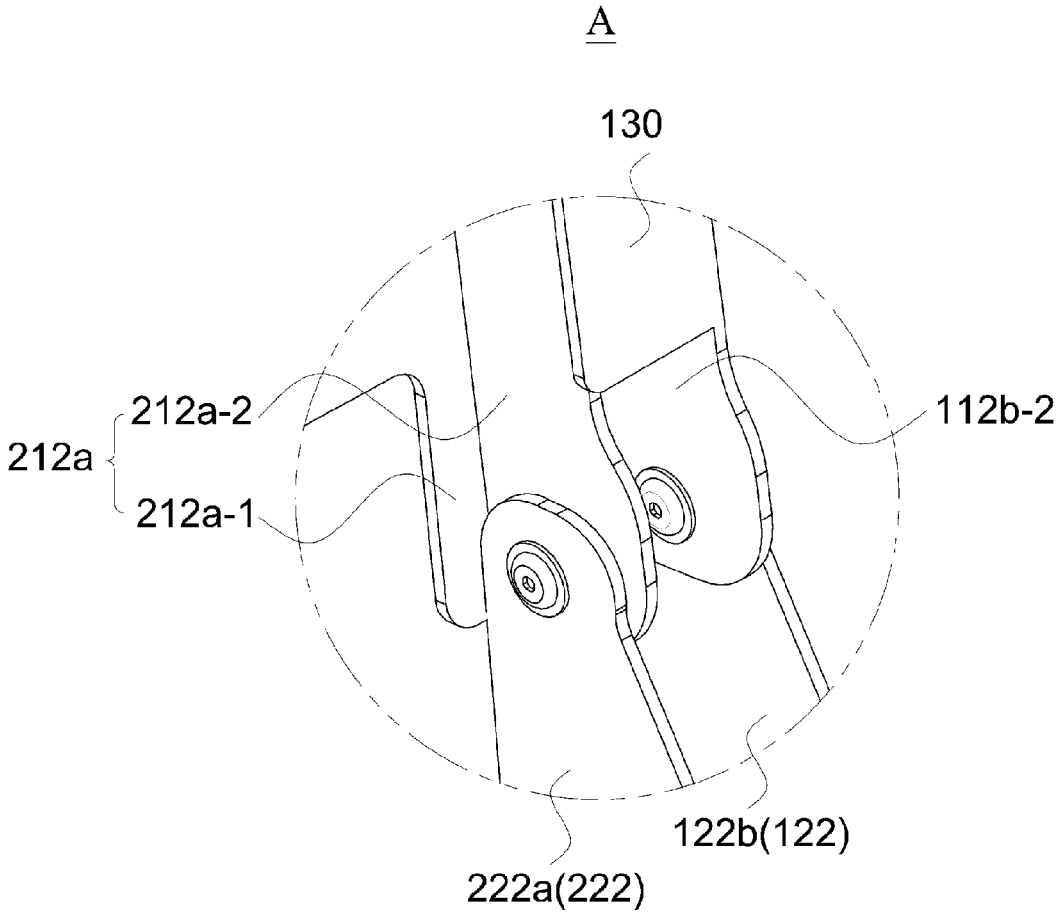
FIG. 5 is an enlarged view of region A of FIG. 3.

FIG. 3 is an exploded perspective view of FIG. 2, FIG. 4 is a schematic perspective view illustrating a portion of a rotation adjustment system for seats according to an embodiment of the present invention, and FIG. 5 is an enlarged view of region A of FIG. 3.

Referring to FIGS. 3 to 5, a rotation adjustment system for seats according to an embodiment of the present invention may include a first viewing chair 100 having a first seat part 120 and a first backrest part 110, and a second viewing chair 200 having a second seat part 220 and a second backrest part 210.

The first and second viewing chairs 100 and 200 are disposed on a plate-shaped seat step and may be moved to a lower side of a seat step located on the upper side thereof or may be drawn toward the front side thereof from the lower side of a seat step located on the upper side thereof.

The first viewing chair 100 may include the first seat part 120 and the first backrest part 110, and the first seat part 120 may provide a space on which a user may be seated, and the first backrest part 110 may be disposed to be approximately perpendicular to the first seat part 120 such that the user sitting on the first seat part 120 may lean thereagainst.

The first seat part 120 may include a first fixed part 122 fixed to the seat step to provide an axis about which the first backrest part 110 is rotated, and a first seat member 124 fixed to the first fixed part 122 to support a portion of the user body.

The first fixed part 122 may include a 1-1th fixed part 122*a* and a 1-2th fixed part 122*b* which are disposed to be spaced a distance corresponding to the width of the first seat member 124 from each other such that the first seat member 124 may be mounted between the 1-1th fixed part 122*a* and the 1-2th fixed part 122*b*.

Also, the 1-1th fixed part 122*a* and the 1-2th fixed part 122*b* may be integrally formed such that the first seat member 124 may be mounted thereon.

The first seat member 124 may be curvedly formed such that a user may feel comfortable while being seated thereon, and may be formed of a material which may give a cushion feel to the user.

The first backrest part 110 may be rotated to be stood from the first seat part 120 so as to maintain the seating function of the first seat part 120, and may be rotated to be laid down toward the first seat part 120 so as to disable the seating function of the first seat part 120.

Specifically, the first backrest part 110 may be rotatably connected to the first seat part 120, and disposed to be approximately perpendicular to the first seat part 120 so that a user seated on the first seat part 120 may lean thereagainst.

Also, the first backrest part 110 may include a first rotatable part 112 rotatably connected to the first fixed part 122, and a first support part 114 providing a space against which a user seated on the first seat member 124 may lean.

The first rotatable part 112 may include a 1-1th rotatable part 112*a* connected to the 1-1th fixed part 122*a*, and a 1-2th rotatable part 112*b* connected to the 1-2th fixed part 122*b* so as to allow the first support part 114 to be mounted between the 1-1th rotatable part 112*a* and the 1-2th rotatable part 112*b*.

Here, the 1-1th rotatable part 112*a*, and the 1-2th rotatable part 112*b* may be integrally formed so as to allow the first support part 114 to be mounted therebetween, and the first support part 114 may be curvedly formed such that a user feel comfortable while leaning thereagainst and may be formed of a material which may give a cushion feel to the user.

The second seat part 220 may be disposed adjacent to the first seat part 120, and may include a second fixed part 222 fixed to the seat step to provide an axis about which the second backrest part 210 is rotated, and a second seat member 224 fixed to the second fixed part 222 to support a portion of the user body.

The second fixed part 222 may include a 2-1th fixed part 222*a* and a 2-2th fixed part 222*b* which are disposed to be spaced apart from each other, and since the 2-1th fixed part 222*a* and the 2-2th fixed part 222*b* have the same shape and function as the 1-1th fixed part 122*a* and a 1-2th fixed part 122*b*, a more description thereon will not be provided.

Also, the second backrest part 210 may include a second rotatable part 212 rotatably connected to the second fixed part 222, and a second support part 214 providing a space against which a user seated on the second seat member 224 may lean.

The second rotatable part 212 may include a 2-1th rotatable part 212*a* and a 2-2th rotatable part 212*b* which are disposed to be spaced apart from each other, and since the 2-1th rotatable part 212*a* and the 2-2th rotatable part 212*b* have the same shape and function as the 1-1th rotatable part 112*a* and a 1-2th rotatable part 112*b*, a more description thereon will not be provided.

The first backrest part 110 may include a protrusion part 130 which protrudes from the first rotatable part 112 toward the second backrest part 210 so as to be positioned on a rotation path of the second backrest part 210, and when the first and second backrest parts 110 and 210 are simultaneously stood or laid down, contacts the second backrest part 210.

Specifically, the 1-2th rotatable part 112*b* adjacent to the second backrest part 210 may include a first connection part 112*b*-1 supporting the back of a user, and a first bent part 112*b*-2 which is bent toward in a front surface direction from the first connection part 112*b*-1 and connected to be rotated about the first seat part 120.

The front surface direction may be the direction, when the first backrest part 110 is stood with respect to the first seat part 120, from the first connection part 112*b*-1 toward a space in which a user may be seated on the first seat part 120.

Also, the first bent part 112*b*-2 may be rotatably connected to the first seat part 120, and the protrusion part 130 may be formed to be bent from the first bent part 112*b*-2 toward the second backrest part 210.

Here, the protrusion part 130 may be continuously formed along the length direction of the first bent part 112*b*-2, and may have a plate shape protruding from the first bent part 112*b*-2 toward the second backrest part 210.

Also, the protrusion part 130 may be formed to have the thickness gradually decreasing from the first bent part 112*b*-2 toward the second backrest part 210. This is for fixing a problem that when the protrusion part 130 contacts a contact part 230, a connection portion between the protrusion part 130 and the first bent part 112*b*-2 may be weakened by an external force applied to the protrusion part 130.

The second backrest part 210 may include the contact part 230 which is inserted from the second rotatable part 212, and when being simultaneously stood and laid down with the first backrest part 110, contacts the protrusion part 130.

Specifically, the 2-1th rotatable part 212*a* adjacent to the first backrest part 110 may include a second connection part 212*a*-1 supporting the back of a user, and a second bent part 212*a*-2 which is bent in the front surface direction from the second connection part 212*a*-1 and connected to be rotated with respect to the second seat part 220.

The second bent part 212*a*-2 may be rotatably connected to the second seat part 220, and the contact part 230 may be formed to be bent from the second bent part 212*a*-2 toward the first backrest part 110.

Also, the contact part 230 may be formed to have the size corresponding to the protrusion part 130, and formed to have the thickness gradually decreasing from the second bent part 212*a*-2 towards the first backrest part 110. This may fix a problem that a connection portion between the contact part 230 and the second bent part 212*a*-2 may be weakened by an external force applied to the contact part 230, by increasing the strength between the second bent part 212*a*-2 and the contact part 230.

Also, the contact part 230 may have the length gradually decreasing in the direction away from the second bent part 212*a*-2.

That is, the total shape of the contact part 230 may be formed to have a rounded edge which protrudes toward the first backrest part 110. This may allow a user not to be damaged by the contact part 230 when the second backrest part 210 is stood from the second seat part 220 while the first backrest part 110 is laid down toward the first seat part 120. In other words, if the edge of the contact part 230 is formed in an angled state, a user may be damaged by the edge of the contact part 230 in case in which the user moves or is seated on the second seat part 220. However, to prevent this, the contact part 230 according to the present invention may be formed to have a rounded edge.

When the first backrest part 110 and the second backrest part 210 are simultaneously stood or laid down, the facing surfaces of the protrusion part 130 and the contact part 230 may be in surface-contact with each other.

That is, the rear side surface of the plate-shaped protrusion part 130 and the front side surface of the plate-shaped contact part 230 may contact each other in the case in which the first and second backrest parts 110 and 210 are simultaneously stood or laid down. In other words, when the first and second backrest parts 110 and 210 are simultaneously stood or laid down, the protrusion part 130 and the contact part 230 may overlap each other.

Here, the front side surface of the contact part 230 may be hidden not to be exposed the outside in the case of contacting the rear side surface of the protrusion part 130.

In order to facilitate the overlap of the protrusion part 130 and the contact part 230, the length in the width direction of the first bent part 112*b*-2 may be greater than that of the second bent part 212*a*-2.

That is, the length in the width direction of the first bent part 112*b*-2 is formed greater than that of the second bent part 212*a*-2 by the thickness of the contact part such that the first bent part 112*b*-2 and the second bent part 212*a*-2 may be coplanar in the case in which the protrusion part 130 and the contact part 230 overlap each other. As a result, the first backrest part 110 and the second backrest part 210 may be positioned to be coplanar with each other.

As the protrusion part 130 and the contact part 230 contact each other or are spaced apart from each other, the positions of the first and second backrest parts 110 and 210 may be moved together or individually moved.

More specifically, in the first viewing chair 100, the first backrest part 110 is stood from the first seat part 120 to allow the second backrest part 210 in a laid down state to be stood from the second seat part 220 or to allow the second backrest part 210 in a stood state to maintain the stood state. Also, in the second viewing chair 200, the second backrest part 210 is laid down toward the second seat part 220 to allow the first backrest part 110 in the stood state to be laid down toward the first seat part 120 or to allow the first backrest part 110 in a laid down state to maintain the laid down state The aforementioned relative relation of the positional movement between the first viewing chair 100 and the second viewing chair 200 will be described in detail through FIGS. 6 to 13.

Figure 6:
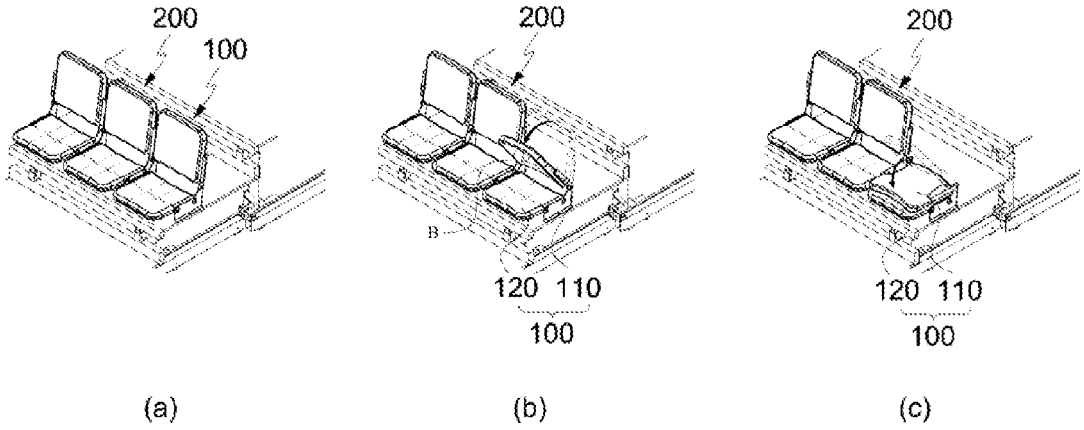
FIG. 6 is a schematic view for describing the operation of a rotation adjustment system for seats according to an embodiment of the present invention.
Figure 7:
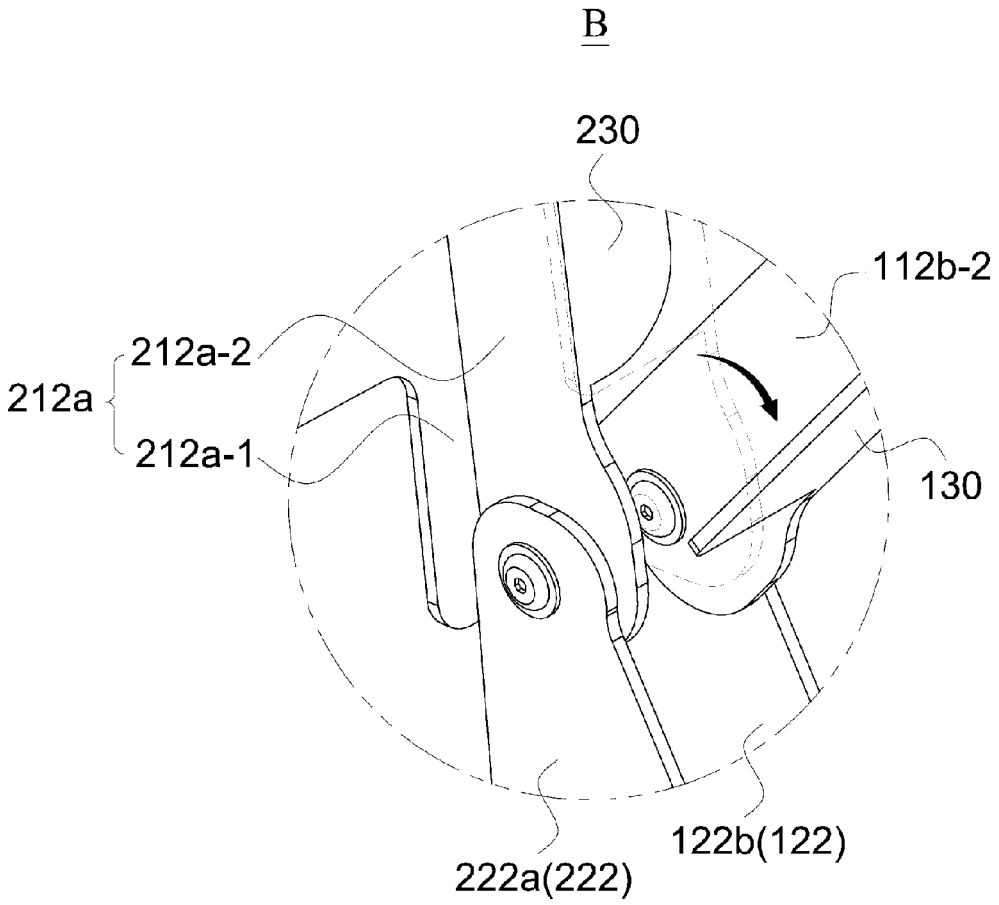
FIG. 7 is an enlarged view of region B of FIG. 6.

FIG. 6 is a schematic view for describing the operation of a rotation adjustment system for seats according to an embodiment of the present invention, and FIG. 7 is an enlarged view of region B of FIG. 6.

Figure 8:
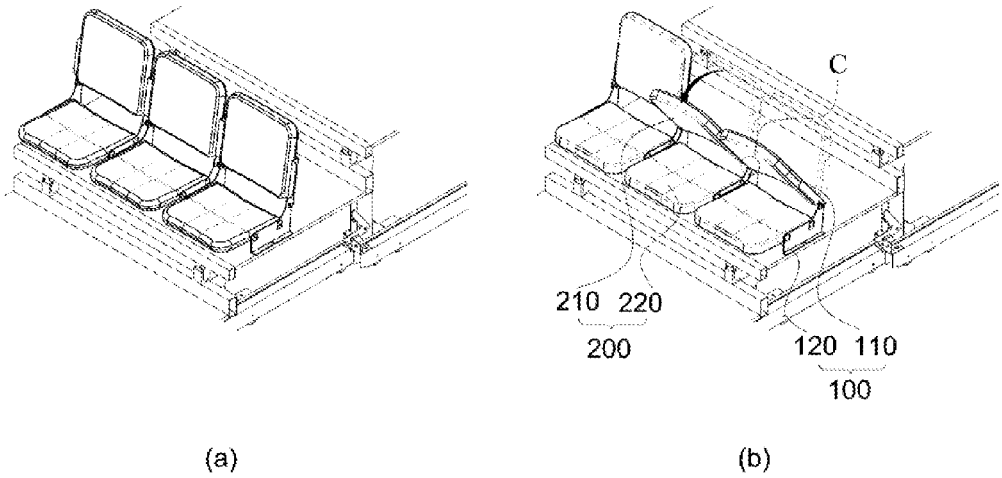
FIG. 8 is a schematic view for describing the operation of a rotation adjustment system for seats according to an embodiment of the present invention.
Figure 9:
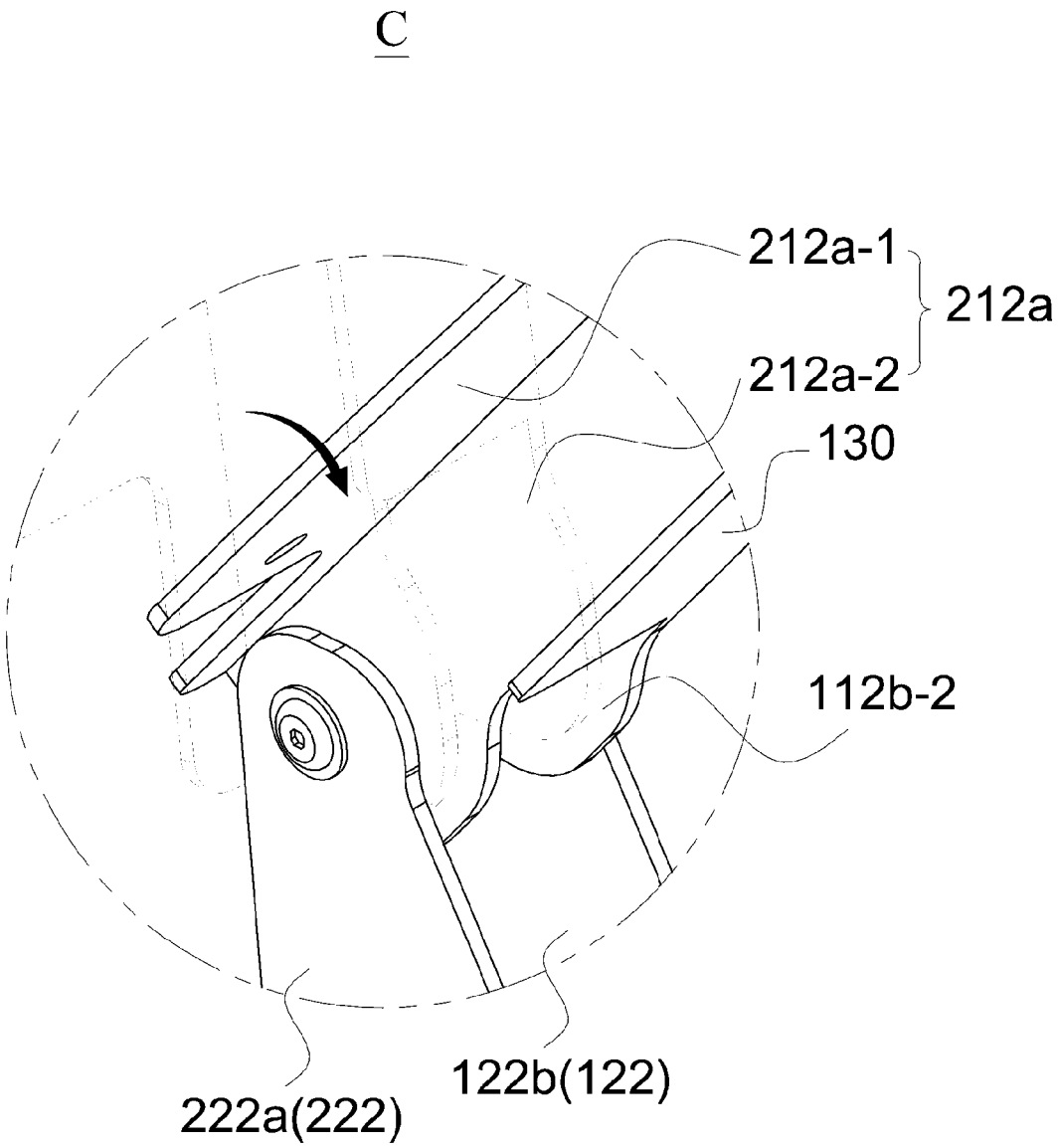
FIG. 9 is an enlarged view of region C of FIG. 8.

FIG. 8 is a schematic perspective view for describing the operation of a rotation adjustment system for seats according to an embodiment of the present invention, and FIG. 9 is an enlarged view of region C of FIG. 8.

Referring to FIGS. 6 to 9, viewing chairs the positions of which are relatively moved as the position of the first viewing chair 100 or the second viewing chair 200 moves, while the seating functions of the first viewing chair 100 and the second viewing chair 200 are maintained, will be described.

Referring to FIGS. 6 and 7, while both the first and second backrest parts 110 and 210 are stood, the first backrest may be allowed to be rotated with respect to the first seat part 120 by applying an external force to the first backrest part 110.

Here, when both the first and second backrest parts 110 and 210 are stood, the protrusion part 130 of the first backrest part 110 and the contact part 230 of the second backrest part 210 may contact each other, and when the first backrest part 110 is rotated from the first seat part 120 by an external force, the protrusion part 130 and the contact part 230 may be spaced apart from each other.

Here, the position of the second backrest part 210 may not be moved even when the first backrest part 110 is laid down. That is, when the second backrest part 210 is stood, the first backrest part 110 may be rotated from the first seat part 120 so as to be independently stood or laid down.

When the first backrest part 110 is rotated from the first seat part 120 to be laid down, a user may not be seated on the first seat part 120 and a user may be seated on the second seat part 220.

Referring to FIGS. 8 and 9, while both the first and second backrest parts 110 and 210 are stood, the second backrest may be allowed to be rotated with respect to the second seat part 220 by applying an external force to the second backrest part 210.

Here, the first backrest part 110 may be rotated together with the second backrest part 210 toward the first seat part 120.

That is, when the second backrest part 210 is rotated toward the second seat part 220, the contact part 230 of the second backrest part 210 is rotated while contacting the protrusion part 130 of the first backrest part 110, and thus the first backrest part 110 may be also rotated with respect to the first seat part 120.

In other words, the contact part 230 may only move together with the protrusion part 130 which is disposed on the rotation path of the contact part 230, and thus the second backrest part 210 and the first backrest part 110 may be laid down together with each other.

To sum up, when the second backrest part 210 falls down toward the second seat part 220 while both the first backrest part 110 and the second backrest part 210 are stood, the second backrest part 210 contacts the first backrest part 110 to allow the first backrest part 110 to be laid down toward the first seat part 120.

That is, a user may also allow the stood first backrest part 110 to be laid down by allowing the stood second backrest part 210 to be laid down by applying an external force to the second backrest part 210.

Figure 10:
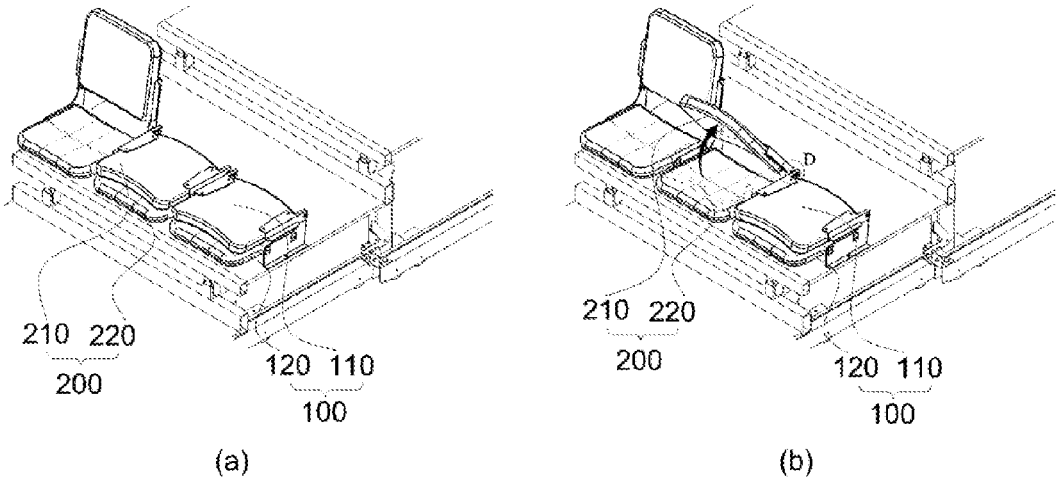
FIG. 10 is a schematic view for describing the operation of a rotation adjustment system for seats according to an embodiment of the present invention.
Figure 11:
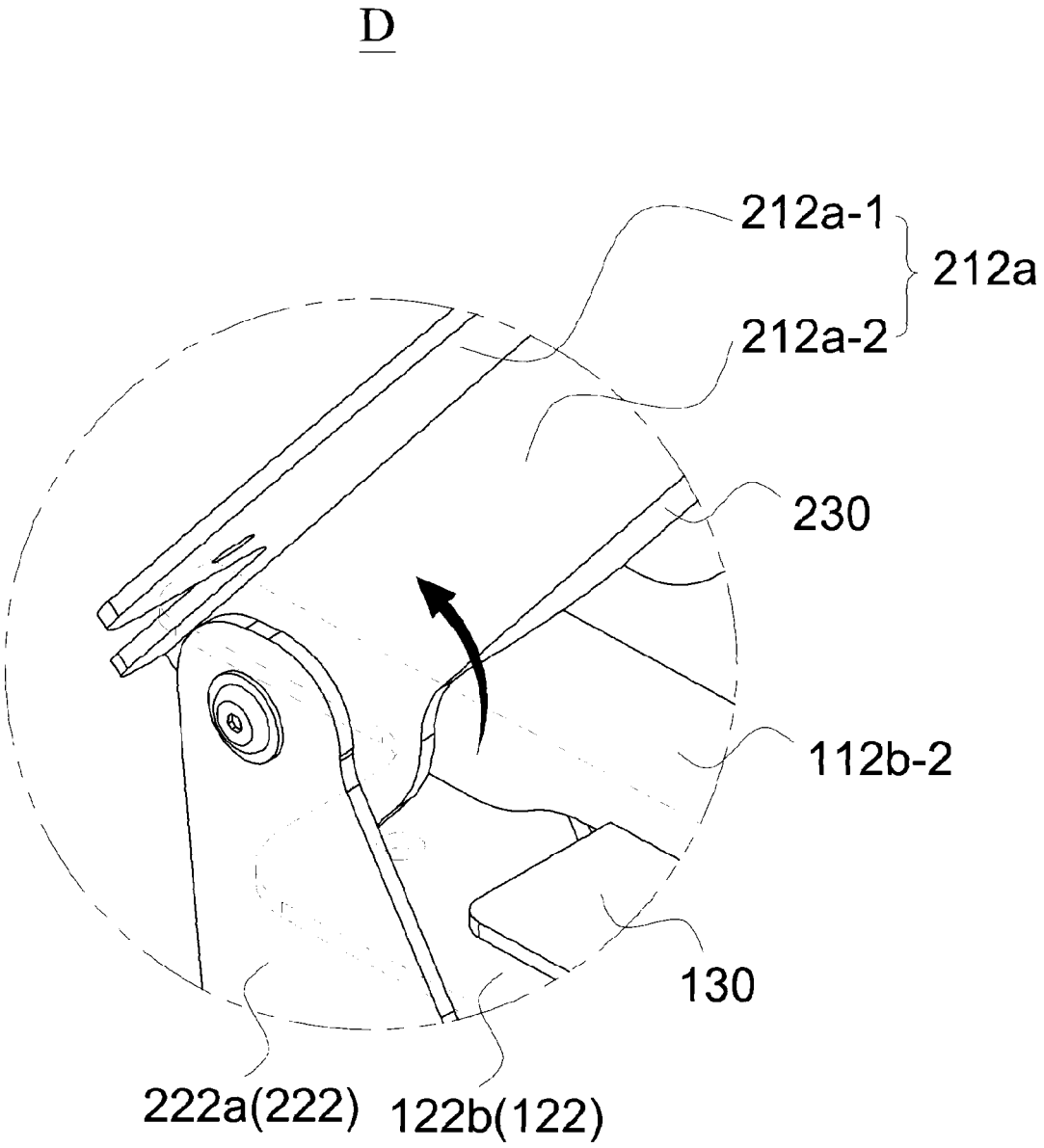
FIG. 11 is an enlarged view of region D of FIG. 10.

FIG. 10 is a schematic view for describing the operation of a rotation adjustment system for seats according to an embodiment of the present invention, and FIG. 11 is an enlarged view of region D of FIG. 10.

Figure 12:
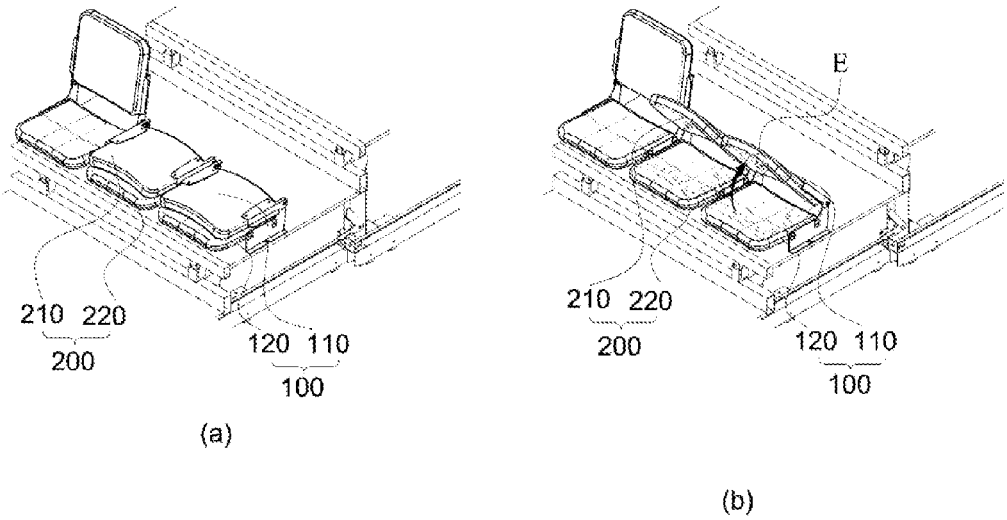
FIG. 12 is a schematic view for describing the operation of a rotation adjustment system for seats according to an embodiment of the present invention.
Figure 13:
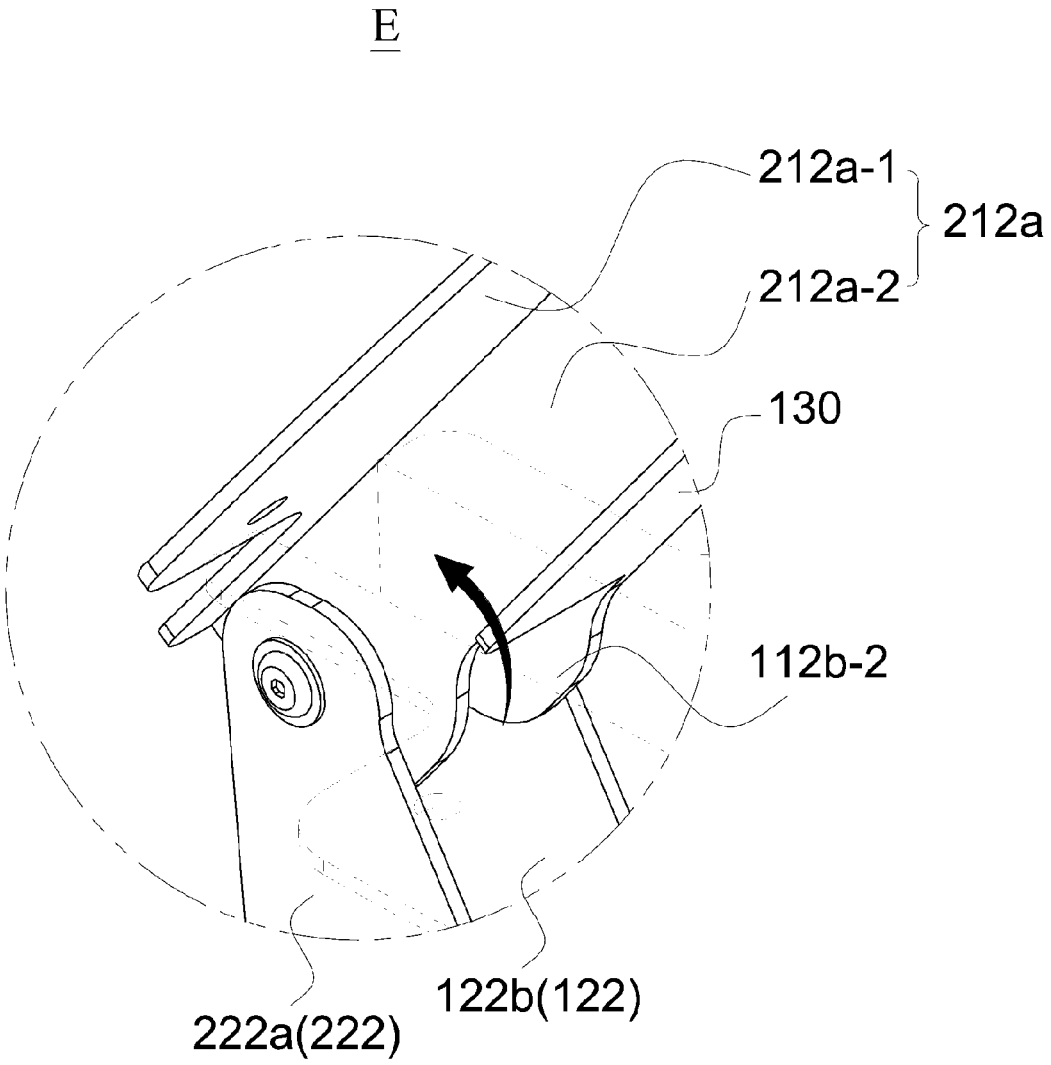
FIG. 13 is an enlarged view of a region E of FIG. 12.

Also, FIG. 12 is a schematic view for describing the operation of a rotation adjustment system for seats according to an embodiment of the present invention, and FIG. 13 is an enlarged view of region E of FIG. 12.

Referring to FIGS. 10 to 13, viewing chairs, the positions of which are relatively moved as the position of the first viewing chair 100 or the second viewing chair 200 moves, while the seating functions of the first viewing chair 100 or the second viewing chair 200 are disabled, will be described.

Referring to FIGS. 10 and 11, while both the first and second backrest parts 110 and 210 are laid down, the second backrest part 210 may be allowed to be rotated with respect to the second seat part 220 by applying an external force to the second backrest part 210.

Here, when both the first and second backrest parts 110 and 210 are laid down, the protrusion part 130 of the first backrest part 110 and the contact part 230 of the second backrest part 210 may contact each other, and when the second backrest part 210 is rotated from the second seat part 220 by an external force, the protrusion part 130 and the contact part 230 may be spaced apart from each other.

Here, the position of the first backrest part 110 may not be moved even when the second backrest part 210 is stood. That is, when the first backrest part 110 is laid down, the second backrest part 210 may be rotated from the second seat part 220 so as to be independently stood or laid down.

This may be easily understood from the configuration in which the protrusion part 130 and the contact part 230 are disposed. That is, when both the first and second backrest parts 110 and 210 are laid down, the second backrest part 210 may be rotated with respect to the second seat part 220 independently of the first backrest part 110. However, the first backrest part 110 may be rotated with respect to the first seat part 120 together with the second backrest part 210, and may not be independently rotated.

When the second backrest part 210 is rotated to be stood from the second seat part 220, a user may be seated on the second seat part 220.

Referring to FIGS. 12 and 13, while both the first and second backrest parts 110 and 210 are laid down, the first backrest part 110 may be allowed to be rotated with respect to the first seat part 120 by applying an external force thereto.

Here, the second backrest part 210 may be rotated together with the first backrest part 110 from the second seat part 220.

That is, when the first backrest part 110 is rotated from the first seat part 120, the protrusion part 130 of the first backrest part 110 is rotated while contacting the contact part 230 of the second backrest part 210, and thus the second backrest part 210 may also be rotated with respect to the second seat part 220.

In other words, the protrusion part 130 may only move together with the contact part 230 which is disposed on the rotation path of the protrusion part 130, and thus the first backrest part 110 and the second backrest part 210 may be stood together with each other.

To sum up, when the first backrest part 110 is stood from the first seat part 120, while both the first backrest part 110 and the second backrest part 210 are laid down, the first backrest part 110 contacts the second backrest part 210 to allow the second backrest part 210 to be stood from the second seat part 220.

That is, a user may also allow the laid down second backrest part 210 by allowing the laid down first backrest part 110 to be stood by applying an external force to the first backrest part 110.

Figure 14:
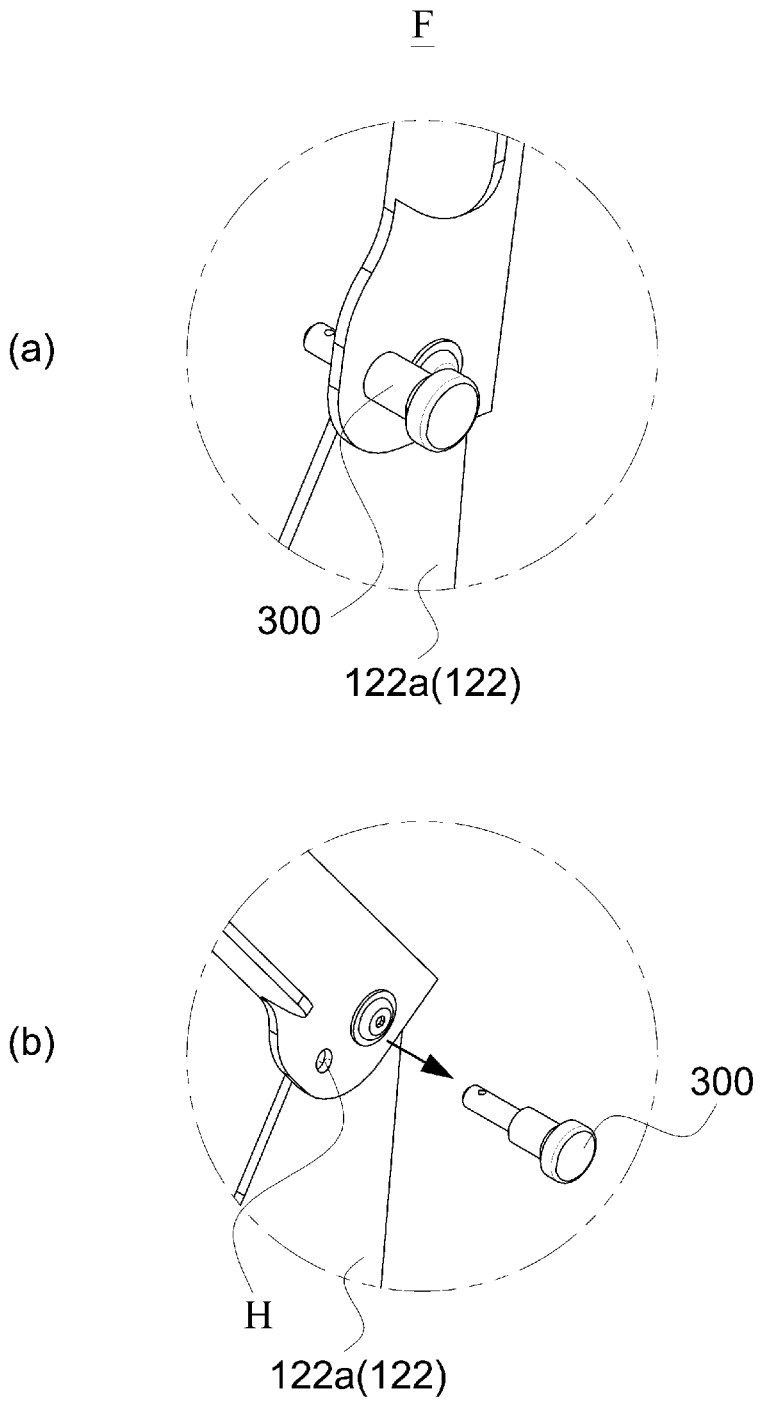
FIG. 14 is an enlarged view of region F of FIG. 2.

FIG. 14 is an enlarged view of region F of FIG. 2.

Referring to FIG. 14, a rotation adjustment system for seats according to an embodiment of the present invention may further include a laid down prevention part 300 preventing the first backrest part 110 from being laid down toward the first seat part 120 by being connected to the first backrest part 110 and the first seat part 120 in the case in which the first backrest part 110 is stood from the first seat part 120.

The laid down prevention part 300 may be simultaneously connected to the first backrest part 110 and the first seat part 120 to prevent the first backrest part 110 being rotated from the first seat part 120.

Specifically, the laid down prevention part 300 may be disposed to pass through the first backrest part 110 and the first seat part 120 at a different position from the rotation axis about which the first backrest part 110 is rotated from the first seat part, so that the first backrest part 110 may be prevented from being rotated by the laid down prevention part 300.

Here, the first backrest part 110 and the first seat part 120 may have a through hole H formed such that the laid down prevention part 300 is mounted thereto by passing through the through hole H, and the laid down prevention part 300 may be attached to or detached from the through hole H.

That is, when the laid down prevention part 300 is attached to the through hole H, the first backrest part 110 may be limited in being rotated from the first seat part 120, and when the laid down prevention part 300 is detached from the through hole H, the first backrest part 110 may be rotated from the first seat part 120.

The laid down prevention part 300 may be a component for preventing a user seated on the first seat part 120 from being damaged or experiencing inconveniency by the first backrest part 110, which is stood from the first seat part 120 and is laid down by an unexpected external force in the case in which the user is seated on the first seat part 120.

Figure 15:
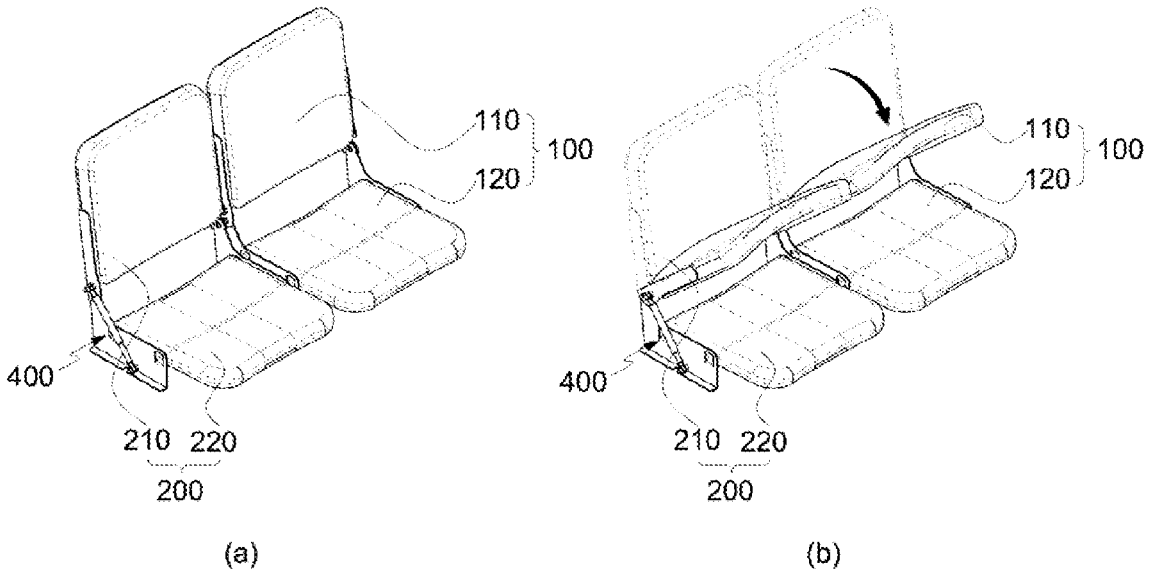
FIG. 15 is a schematic view for describing the operation of a rotation adjustment system for seats according to an embodiment of the present invention.

FIG. 15 is a schematic view for describing the operation of a rotation adjustment system for seats according to an embodiment of the present invention.

Referring to FIG. 15, a rotation adjustment system for seats according to an embodiment of the present invention may further include a cushion part 400 which is disposed between the second seat part 220 and the second backrest part 210, reduces the rotational speed of the second backrest part 210 in the case in which the second backrest part 210 laid down toward the second seat part 220, and allows the second backrest part 210 to be easily stood from the second seat part 220 in the case in which the second backrest part 210 is stood from the second seat part 220.

That is, when the second backrest part 210 is rotated to be laid down toward the second seat part 220, the cushion part 400 collides with the second seat part 220 due to the high rotational speed of the second backrest part 210. To prevent the second backrest part 210 from being broken or damaged, the cushion part 400 is disposed between the second backrest part 210 and the second seat part 220, and functions to reduce the rotational speed of the second backrest part 210 toward the second seat part 220.

Also, when the second backrest part 210 laid down toward the second seat part 220, the cushion part 400 may be elastically deformed, and when the second backrest part 210 is stood from the second seat part 220, the cushion part 400 may allow the second backrest part 210 to be easily stood from the second seat part 220 by the recovering force due to the elastic deformation.

Here, the cushion part 400 may be a hydraulic or an air cylinder, and a well known technique provided with a deformation and a recovering force due to the elastic deformation may be used.

When the first backrest part 110 is simultaneously stood together with the second backrest part 210, if the second backrest part 210 is laid down toward the second seat part 220, the first backrest part 110 may also laid down from the first seat part 120 in line with the second backrest part. Here, if the rotational speed of the second backrest part 210 toward the second seat part 210 is decreased by the cushion part 400, the rotational speed of the first backrest part 110 toward the first seat part 120 may also be decreased in line with the second backrest part 210.

That is, although disposed between the second seat part 220 and the second seat part 210, the cushion part 400 may reduce the rotational speed of the first backrest part 110 toward the first seat part 120.

Although the relative positional movements of the first and second viewing chairs are mainly described in the above, the rotation adjustment system for seats according to an embodiment of the present invention, as described in the beginning, may be applied to all the plurality of viewing chairs.

Specifically, the contact part may be disposed on the 2-1th rotatable part of the second viewing chair, the protrusion part may be disposed on the 2-2th rotatable part, and the relative positional movement relation between the first viewing chair and the second viewing chair may be applied to the second viewing chair and the third viewing chair adjacent to the second viewing chair.

Further, when the viewing chairs are provided in plurality, each viewing chair is provided with the contact part and the protrusion part so as to be stood or to be laid down simultaneously, and may be individually stood or laid down under a predetermined condition.

According to the rotation adjustment system for seats according to the present invention, a plurality of viewing chairs may be simultaneously rotated to facilitate the switching between a use state and non-use state.

Also, when a user is seated on the viewing chair, the chair is prevented from being switched from the use state to the non-use state by an external force, and thus the user may not be damaged or experience inconveniency.

Further, the rotating speed at which the backrest part is rotated toward the seat part in the viewing chair may be reduced to prevent the backrest part and the seat part to be broken or damaged.

Although the configuration and characteristic of the present invention have been described in the above with respect to exemplary embodiments of the present invention, it is obvious to one ordinary skilled in the art that the present invention should not be limited to these exemplary embodiments but various changes and modifications can be made within the spirit and scope of the present invention as hereinafter claimed. Thus, such changes or modifications should be understood as falling within the claims of the present invention.

What is claimed is:

1. A rotation adjustment system for seats, comprising:

a first viewing chair comprising a first seat part on which a first user is allowed to be seated, and a first backrest part which is rotatably connected to the first seat part, is stood from the first seat part to maintain a seating function of the first seat part, and is laid down toward the first seat part to disable the seating function of the first seat part; and a second viewing chair comprising a second seat part which is disposed adjacent to the first seat part and on which a second user is allowed to be seated, and a second backrest part which is rotatably connected to the second seat part, is stood from the second seat part to maintain a seating function of the second seat part, and is laid down toward the second seat part to disable the seating function of the second seat part, wherein when the first backrest part is stood from the first seat part and the second backrest part is stood from the second seat part or when the first backrest part is laid down toward the first seat part and the second backrest part is laid down toward the second seat part, a part of the first backrest part and a part of the second backrest part overlap each other, the part of the first backrest part and the part of the second backrest part being in surface-contact with each other, wherein if the first backrest part is stood from the first seat part in a state in which the first backrest part is laid down toward the first seat part and the second backrest part is laid down toward the second seat part, the second backrest part is stood from the second seat part together the first backrest part by the overlap, and wherein if the second backrest part is laid down toward the second seat part in a state in which the first backrest part is stood from the first seat part and the second backrest part is stood from the second seat part, the first backrest part is laid down toward the first seat part together the second backrest part by the overlap.

2. The rotation adjustment system of claim 1, wherein the first backrest part comprises a first support part for supporting a back of the first user who is seated on the first seat part, and a protrusion part fixed on a side of the first support part, wherein the second backrest part comprises a second support part for supporting a back of the second user who is seated on the second seat part, and a contact part fixed on the side of the second support part, and wherein the protrusion part and the contact part are the part of the first backrest part and the part of the second backrest part, respectively.

3. The rotation adjustment system of claim 2, wherein when the first backrest part is laid down toward the first seat part and the second backrest part is laid down toward the second seat part, the protrusion part is covered with the contact part.

4. The rotation adjustment system of claim 2, wherein the first backrest part further comprises a first rotatable part connected to the protrusion part and the first support part so that the protrusion part is fixed on the side of the first support part, and wherein the second backrest part further comprises a second rotatable part connected to the contact part and the second support part so that the contact part is fixed on the side of the second support part.

5. The rotation adjustment system of claim 4, wherein the first rotatable part comprises a first connection part mounted on a rear surface of the first support part, and a first bent part formed by being bent from the first connection part toward a front surface of the first support part, wherein the protrusion part is formed by being bent from the first bent part toward the side of the second support part, wherein the second rotatable part comprises a second connection part mounted on a rear surface of the second support part, and a second bent part formed by being bent from the second connection part toward a front surface of the second support part, wherein the contact part is formed by being bent from the second bent part toward the side of the first support part, wherein the protrusion part is continuously formed along a length direction of the first bent part, and wherein the contact part is continuously formed along the length direction of the second bent part.

6. The rotation adjustment system of claim 5, wherein the contact part has a length gradually decreasing in a direction away from the second bent part.

7. The rotation adjustment system of claim 5, wherein a width of the first bent part is greater than that of the second bent part.

8. The rotation adjustment system of claim 5, wherein a width of the first bent part is greater than that of the second bent part by a thickness of the contact part.

9. The rotation adjustment system of claim 2, wherein a size of the protrusion part is greater than that of the contact part.

* * * * *